United States Patent [19]

Lee

[11] Patent Number: 4,890,206

[45] Date of Patent: Dec. 26, 1989

[54] CHRISTMAS LIGHT SET COMPILER

[76] Inventor: Shu-Hwa Lee, 7F, 16, Alley 3, Land 227, Nung-An St., Taipei, Taiwan

[21] Appl. No.: 361,215

[22] Filed: Jun. 5, 1989

[51] Int. Cl.[4] ..... F21S 1/14

[52] U.S. Cl. ..... 362/227; 362/249; 362/250; 362/252; 362/392; 362/393; 362/806

[58] Field of Search ..... 362/121, 122, 123, 145, 362/147, 151, 152, 227, 249, 250, 252, 806, 807, 808, 810, 396, 392, 393

*Primary Examiner*—Stephen F. Husar

*Assistant Examiner*—Sue Hagarman

*Attorney, Agent, or Firm*—Ladas & Parry

[57] ABSTRACT

A Christmas light set compiler includes a plurality of mounting elements for supporting Christmas light set. The mounting elements each is having a toothed hole and a mounting hole respectively made at both ends, a dowel made at one side in the middle, and a circular retaining hole made at the other side opposite to the dowel such that they may be connected in series or intersected with one another to conform to any of preferred shapes.

5 Claims, 5 Drawing Sheets

CHRISTMAS LIGHT SET COMPILER

BACKGROUND OF THE INVENTION

1. Field of the Invention

This invention is generally related to a Christmas light set compiler and more particularly to a compiler comprised of a plurality of mounting elements which may be connected with one another to conform to any of preferred shapes for supporting Christmas light set.

2. Description of the Prior Art

Christmas light set is an ornamental item commonly used by people everywhere in the world, to decorate a house either indoor or outdoors. In order to produce better decorative effect, a mounting device which has a fixed shape, as shown in FIG, 5, is popularly used for supporting Christmas light set. However, this kind of mounting device is not very practical in use, because of the following problems: (1) The mounting device is arranged in a fixed shape and not changeable. The consumers can not compile the Christmas light set to conform to any preferred shape. (2) The fixed type of conventional mounting device is space consuming. In consequence, the packing and transportation charges for such mounting device are relatively expensive.

U.S. Pat. No. 4,769,749 discloses a new and built-up type mounting device for releasably supporting decorative string or Christmas tree light assembly which includes at least one elongated, platenlike strip for releasably supporting the light assembly, wherein each strip is constructed of a resiliently bendable material permitting the strip to be manually conformed to any of a number of shapes. However, the connection of the strips is more difficult to make, and the related wing nut arrangement is required.

SUMMARY OF THE INVENTION

The main object of the present invention is to provide a Christmas light set compiler, which can be conveniently compiled into any of preferred shapes by consumers without the need for any tools or fastening means.

Another object of the present invention is to provide a Christmas light set compiler for supporting Christmas light set, which is practical for mass production to reduce the cost, and is a built-up type to minimize space consumption for convenience of transportation and storage.

According to the present invention, a Christmas light set compiler is comprised of a plurality of mounting elements for supporting Christmas light set, wherein the mounting elements each have a toothed hole and a mounting hole respectively made at both ends, a dowel made at one side in the middle, and a circular retaining hole made at the other side opposite to the dowel, and wherein the mounting elements may be connected in series and/or intersected with one another, by means of the matching of the mounting hole and/or the dowel of one mounting element with the toothed hole and/or the circular retaining hole of anther mounting element, to conform to any of preferred shapes.

DETAILED DESCRIPTION OF THE PREFERRED EMBODIMENTS

Figure 1:
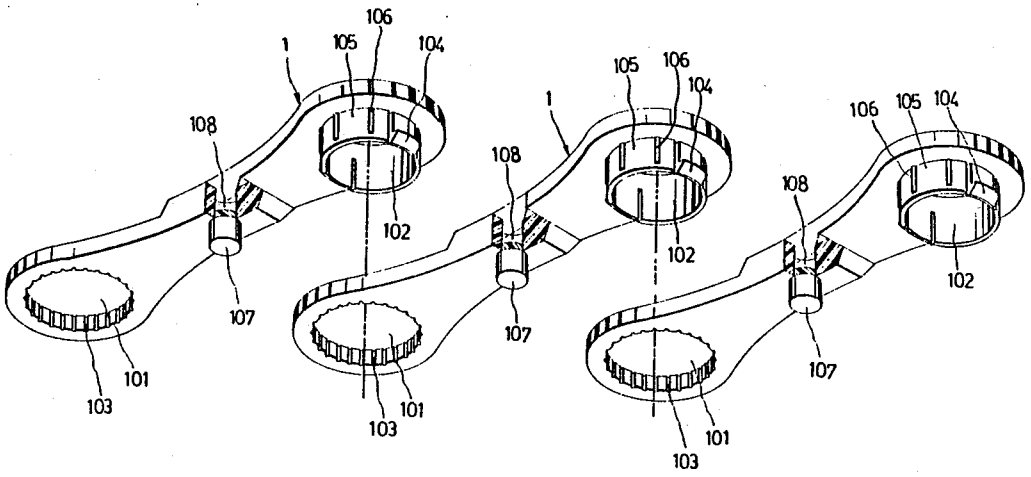
FIG. 1 is a schematic drawing, illustrating the structure of the mounting element of the Christmas light compiler of the present invention for supporting Christmas light set.

Referring to FIG. 1, a Christmas light set compiler includes a plurality of mounting elements (1) for supporting a Christmas light set. The mounting element (1) has a toothed hole (101) and a mounting hole (102) respectively made at each end, a dowel (107) made at one side in the middle, and a circular retaining hole (108) made at the other side opposite to the dowel (107), wherein the ring-shaped wall (105) has a retainer block (104) made on the top, and a pluraity of rectilinear projections (106) vertically made on the outer wall surface.

Figure 2:
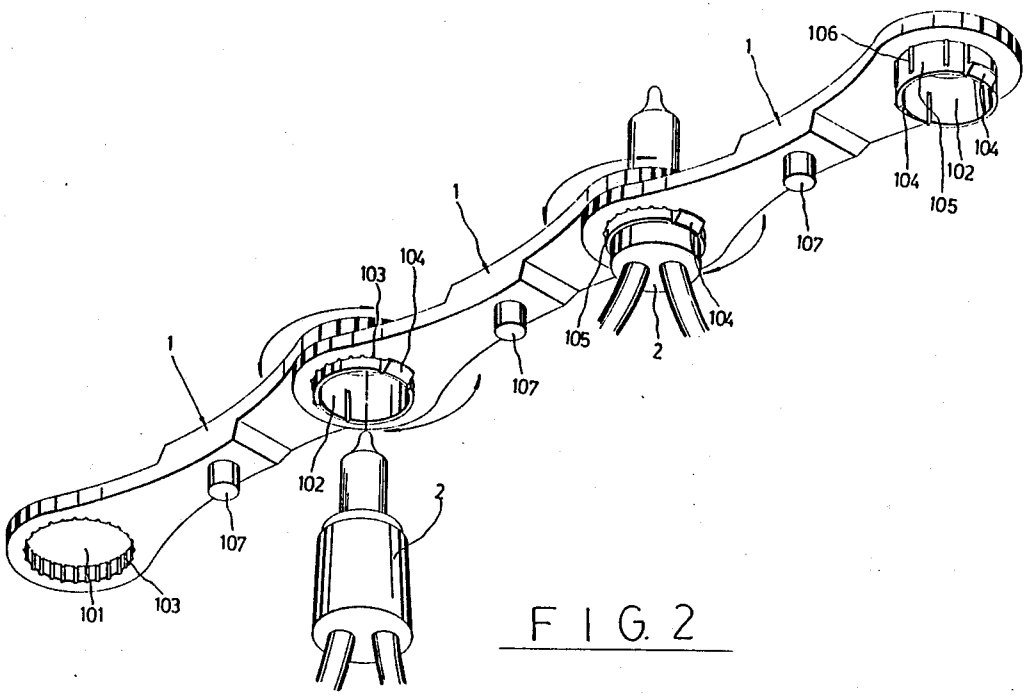
FIG. 2 is a schematic drawing illustrating the process to connect mounting elements with one another by means of series connection for further mounting thereon of Christmas light set.

With reference to FIG. 2, when assembled, the ring-shaped wall (105) of the mounting hole (102) of the first mounting element (1) is inserted into the toothed hole (101) of the second mounting element (1) from the top with the retainer block (104) retained at the bottom edge of the toothed hole (101) of the second mounting element (1) and with the rectilinear projections (106) of the first mounting element (1) respectively engaged with the teeth (103) of the second mounting element (1). According to this connection method, a mounting element (1) may be connected to another mounting element (1) at any preferred angular position. Therefore, a plurality of mounting elements (1) may be connected by means of series connection to form into any configuration preferred, that is any preferred shape of character or pattern can be compiled by means of the arrangement to connect a certain amount of mounting elements (1) together. As soon as a preferred pattern or character is compiled, the sockets (2) of the Christmas light set are respectively set in the mounting holes (102) of the mounting elements (1).

Figure 3:
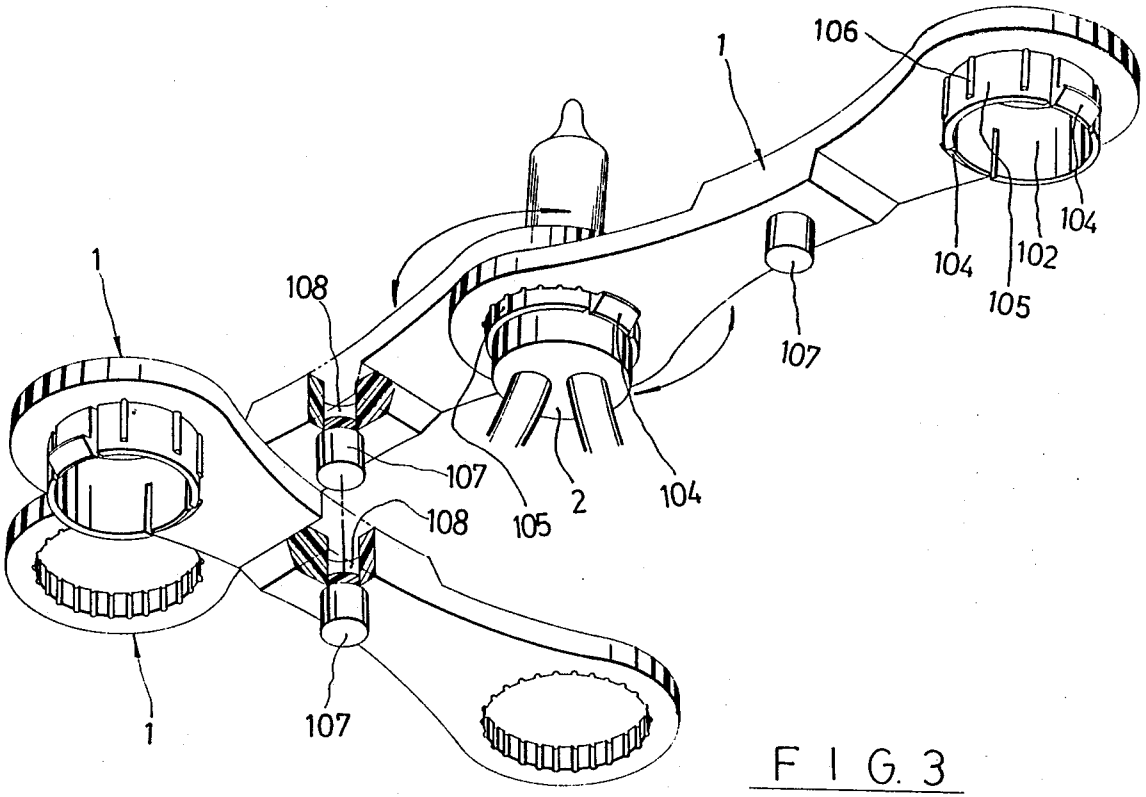
FIG. 3 is a schematic drawing, illustrating the process to intersect one mounting element with the other.
Figure 4:
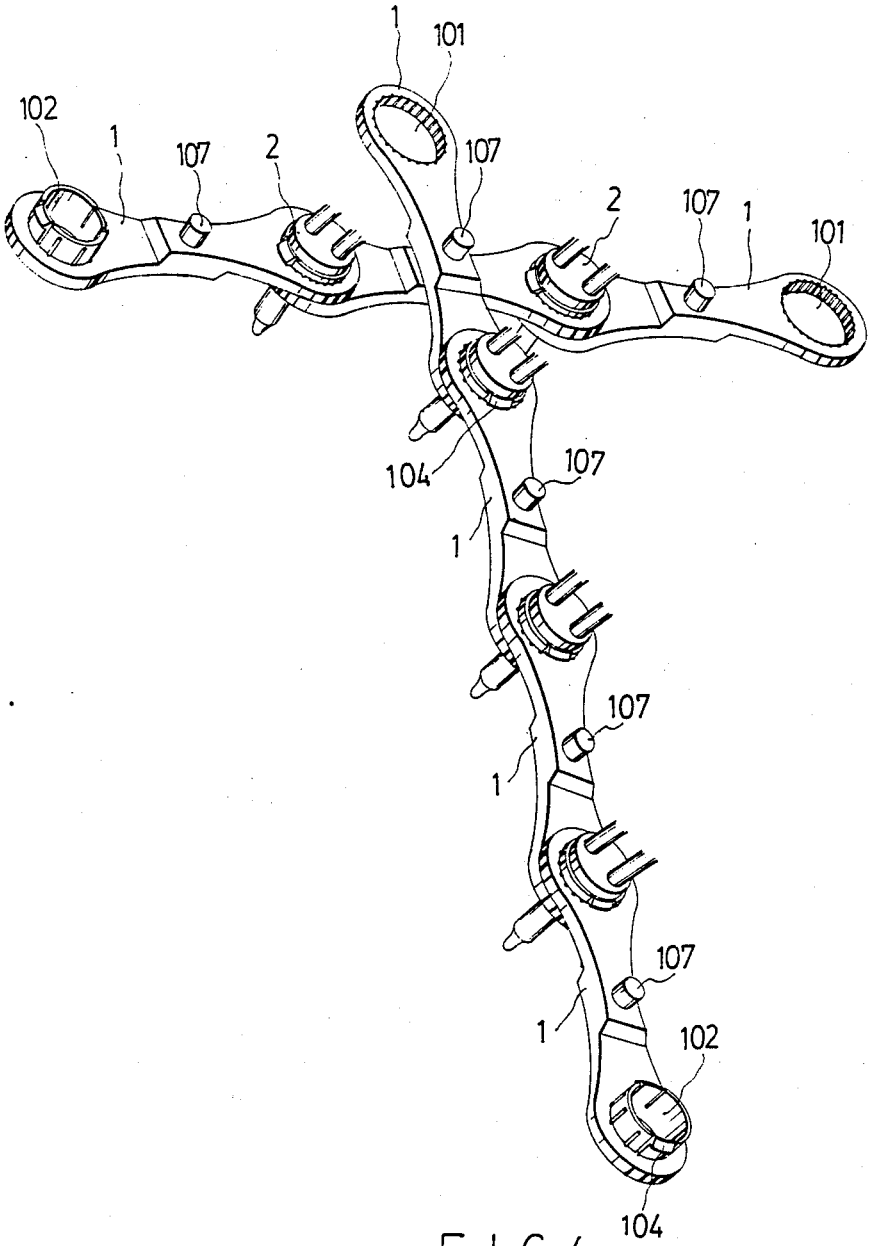
FIG. 4 is another schematic drawing of the present invention, in which several mounting elements are connected or intersected with one another.
Figure 5:
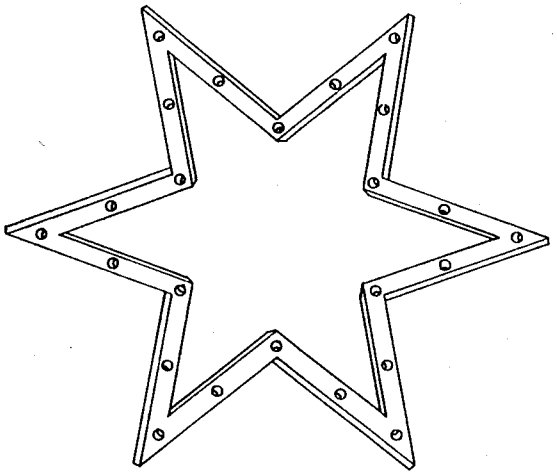
FIG. 5 is a schematic view of an ornamental mounting device according to the prior art.

With reference to FIGS. 3 and 4, two mounting elements (1) may be intersected with each other by means of inserting the dowel (107) of the first mounting element (1) into the retaining hole (108) of the second mounting element (1).

What is claimed:

1. A Christmas light set compiler comprised of a plurality of mounting elements for supporting Christmas light set, said mounting elements each having a toothed hole and a mounting hole respectively made at each end a dowel disposed at one side in the middle of said mounting elements, and a circular retaining hole disposed at the other side of said mounting elements opposite to said dowel, said mounting elements being connectable with one another by means of matching of the mounting hole and/or the dowel of one mounting element with the toothed hole and/or the circular retaining hole of another mounting element, to conform to any preferred shape.

2. The Christmas light set compiler as set forth in claim 1, wherein the toothed hole of each of said mounting elements has a plurality of teeth vertically made thereon at the inner wall surface.

3. The Christmas light set compiler as set forth in claim 1, wherein the mounting hole of each of said mounting elements has a ring-shaped wall integrally extended therefrom with a retainer block made on the top and with a plurality of rectilinear projections made on the outer wall surface.

4. The Christmas light set compiler as set forth in claim 1, wherein the said mounting elements may be flexibly connected with one another, at any preferred angular position, by means of series connection, to let the ring-shaped wall of the mounting hole of one mounting element be inserted into the toothed hole of another mounting element with the retainer block of the first mounting element retained at the bottom edge of the toothed hole of the second mounting element and with the rectilinear projections of the first mounting element respectively engaged with the teeth of the second mounting element.

5. The Christmas light set compiler as set forth in claim 1, wherein the said mounting elements may be intersected with one another by means of inserting the dowel of one mounting element into the retaining hole of another mounting element.

* * * * *